US012773013B2

(12) United States Patent
Xie et al.

(10) Patent No.: US 12,773,013 B2
(45) Date of Patent: Oct. 27, 2026

(54) ATOMIZER AND ELECTRONIC ATOMIZATION APPARATUS

(71) Applicant: SHENZHEN FIRST UNION TECHNOLOGY CO., LTD., Shenzhen (CN)

(72) Inventors: Baofeng Xie, Shenzhen (CN); Fuwen Lin, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 539 days.

(21) Appl. No.: 18/262,085

(22) PCT Filed: Jan. 19, 2022

(86) PCT No.: PCT/CN2022/072795
§ 371 (c)(1),
(2) Date: Jul. 19, 2023

(87) PCT Pub. No.: WO2022/156719
PCT Pub. Date: Jul. 28, 2022

(65) Prior Publication Data

US 2024/0148066 A1 May 9, 2024

(30) Foreign Application Priority Data

Jan. 20, 2021 (CN) ..... 202110075225.3

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/46* (2020.01); *A24F 40/44* (2020.01); *A24F 40/51* (2020.01)

(58) Field of Classification Search
CPC ..... A24F 40/50; A24F 40/51; A24F 40/44; A24F 40/48; A24F 40/46; A24F 40/40; A24F 40/10
See application file for complete search history.

(56) References Cited

U.S. PATENT DOCUMENTS

2013/0192623 A1* 8/2013 Tucker ..... A61M 11/042 131/329
2014/0311504 A1* 10/2014 Liu ..... A24F 40/46 131/329

(Continued)

FOREIGN PATENT DOCUMENTS

CN 204070572 U 1/2015
CN 104366694 A 2/2015

(Continued)

*Primary Examiner* — Alex B Efta
(74) *Attorney, Agent, or Firm* — PROI Intellectual Property US

(57) ABSTRACT

An vaporizer includes an outer housing; the outer housing is internally provided with: a liquid storage chamber having an opening; a first liquid guide element having a first surface close to the liquid storage chamber in a longitudinal direction of the outer housing, and a second surface away from the first surface; the first surface sucks the liquid substrate; and the first liquid guide element is made from an organic porous material and is configured to cover the opening to seal the liquid storage chamber, such that the liquid substrate in the liquid storage chamber is substantially removed through the first liquid guide element; a second liquid guide element, configured to at least partially contact with the second surface to suck the liquid substrate; and a heating element, configured to heat at least part of the liquid (Continued)

substrate in the second liquid guide element to generate an aerosol.

19 Claims, 12 Drawing Sheets

(51) Int. Cl.
*A24F 40/44* (2020.01)
*A24F 40/46* (2020.01)
*A24F 40/51* (2020.01)

(56) References Cited

U.S. PATENT DOCUMENTS

2017/0188635 A1* 7/2017 Force ..... A24F 40/46
2017/0325502 A1* 11/2017 Nelson ..... A24F 40/70
2018/0177236 A1* 6/2018 Rosser ..... A61M 15/06
2018/0279673 A1* 10/2018 Sebastian ..... A24F 40/44
2019/0328039 A1* 10/2019 Romming ..... A61M 11/042
2020/0113243 A1 4/2020 McKeon et al.
2020/0367556 A1* 11/2020 Lin ..... A24F 40/42

FOREIGN PATENT DOCUMENTS

CN 104366695 A 2/2015
CN 204245152 U 2/2015
CN 204245151 U 4/2015
CN 204466913 U 7/2015
CN 104039182 B 2/2018
CN 111480897 A 8/2020
CN 214962602 U 12/2021
CN 215347010 U 12/2021
WO 2018158566 A1 9/2018

* cited by examiner

ATOMIZER AND ELECTRONIC ATOMIZATION APPARATUS

CROSS-REFERENCE TO RELATED DOCUMENTS

This application claims priority to the earlier application No. 202110075225.3, filed to China National Intellectual Property Administration (CNIPA) of the People's Republic of China on Jan. 20, 2021 and entitled "VAPORIZER AND ELECTRONIC VAPORIZATION DEVICE", the content of which is incorporated herein by reference in the entirety.

TECHNICAL FIELD

Embodiments of this application relate to the technical field of electronic vaporization devices, and in particular, to a vaporizer and an electronic vaporization device.

BACKGROUND

Tobacco products (such as cigarettes, cigars, and the like) burn tobacco during use to produce tobacco smoke. Attempts are made to replace these tobacco-burning products by manufacturing products that release compounds without burning tobacco.

An example of this type of products is a heating device that releases compounds by heating rather than burning materials. For example, the materials may be tobacco or other non-tobacco products, where the non-tobacco products may or may not include nicotine. As another example, there are aerosol-providing products, for example, electronic vaporization devices. These devices usually contain vaporizable liquid, and the liquid is heated to be vaporized, so as to generate an inhalable aerosol.

SUMMARY

Embodiments of this application provide a vaporizer, configured to vaporize a liquid substrate to generate an aerosol. including an outer housing, where the outer housing is internally provided with:

- a liquid storage chamber, configured to store a liquid substrate; the liquid storage chamber having an integrally-formed opening;
- a first liquid guide element having a first surface close to the liquid storage chamber in a longitudinal direction of the outer housing, and a second surface away from the first surface, where the first surface is configured to be in fluid communication with the liquid storage chamber to suck and buffer the liquid substrate in the liquid storage chamber; and the first liquid guide element is made from an organic porous material and is configured to cover the opening to seal the liquid storage chamber, such that the liquid substrate in the liquid storage chamber is substantially removed through the first liquid guide element;
- a second liquid guide element, configured to at least partially contact with the second surface to suck the liquid substrate; and
- a heating element, configured to heat at least part of the liquid substrate in the second liquid guide element to generate an aerosol.

In a preferred embodiment, the first liquid guide element is made from an organic porous material with elasticity.

In a preferred embodiment, the first liquid guide element has an elastic modulus or a stiffness smaller than an elastic modulus or a stiffness of the material of the liquid storage chamber and larger than an elastic modulus or a stiffness of the material of the second liquid guide element.

In a preferred embodiment, the first liquid guide element directly contacts with and covers the opening of the liquid storage chamber.

In a preferred embodiment, the first liquid guide element is configured as a sheet or block perpendicular to the longitudinal direction of the outer housing.

In a preferred embodiment, the first liquid guide element has a length direction perpendicular to the longitudinal direction of the outer housing and a width direction perpendicular to the longitudinal direction and the length direction of the outer housing; and a length dimension of the first liquid guide element is greater than a width dimension of the same.

In a preferred embodiment, the first liquid guide element is anisotropic; and preferably, a flexural strength in a length direction is greater than a flexural strength in a width direction; more preferably, a liquid guide rate in a length direction is greater than a liquid guide rate in a width direction; and further preferably, the first liquid guide element includes fibers arranged and oriented substantially in the length direction.

In a preferred embodiment, the first liquid guide element has a shore hardness of 20-70 A. More preferably, the first liquid guide element has a shore hardness of 50-70 A.

In a preferred embodiment, the second liquid guide element is flexible and has a shore hardness less than a shore hardness of the first liquid guide element.

In a preferred embodiment, there is no flexible sealing material between the first liquid guide element and the liquid storage chamber.

In a preferred embodiment, the first liquid guide element is configured to be in a substantially elliptic cylindrical shape.

In a preferred embodiment, the first surface and/or the second surface of the first liquid guide element has a line extending substantially in the length direction.

In a preferred embodiment, the outer housing is internally provided with a smoke output tube extending longitudinally for outputting an aerosol; and the first liquid guide element is provided with a first insertion hole for the smoke output tube to run through.

In a preferred embodiment, the first insertion hole has an oval cross section; and a length direction of the cross section of the first insertion hole is parallel to a length direction of the first liquid guide element.

In a preferred embodiment, the vaporizer further includes:

- a first support arranged close to the second surface of the first liquid guide element in the longitudinal direction of the outer housing, and configured to at least partially accommodate and retain the second liquid guide element.

In a preferred embodiment, the second liquid guide element includes a first portion extending in a direction perpendicular to the longitudinal direction of the outer housing, and a second portion extending from the first portion to the first liquid guide element, where

- the second portion is configured to contact with the second surface to suck the liquid substrate; and
- the heating element at least partially surrounds the first portion.

In a preferred embodiment, the vaporizer further includes:

- a first support, configured to at least partially define a vaporization chamber surrounding the first portion and/or the heating element.

In a preferred embodiment, the outer housing is internally provided with a smoke output tube extending longitudinally for outputting an aerosol; and the smoke output tube has an air inlet end in airflow communication with the vaporization chamber, and at least part of the smoke output tube close to the air inlet end is exposed to the vaporization chamber.

In a preferred embodiment, the first support is further configured to at least partially retain the first liquid guide element by abutting against the second surface.

In a preferred embodiment, the outer housing has an inner wall at least partially defining the liquid storage chamber;

the inner wall is provided with a first convex edge extending in the longitudinal direction of the outer housing; and the first convex edge is configured to at least partially retain the first liquid guide element by abutting against the first surface.

In a preferred embodiment, the vaporizer further includes:

a second support, accommodated in the first support, and at least partially supporting the second liquid guide element accommodated and retained in the first support.

In a preferred embodiment, the heating element includes a heating portion and an electrical pin for supplying power to the heating portion, where a strength of the electrical pin is greater than a strength of the heating portion; and the electrical pin includes an annular supporting portion formed on two sides of the heating portion and having at least one turn, the annular supporting portion being configured to at least partially support the second liquid guide element by surrounding the first portion.

In a preferred embodiment, the heating element includes a heating portion and an electrical pin for supplying power to the heating portion, where the electrical pin includes an annular supporting portion having at least one turn, the annular supporting portion being configured to at least partially support the second liquid guide element by surrounding the first portion.

In a preferred embodiment, the heating portion includes a first heating coil and a second heating coil at least partially surrounding the first portion, where in the extension direction of the first portion, a position of the first heating coil relative to the first portion is different from a position of the second heating coil relative to the first portion.

In a preferred embodiment, a wire material of the first heating coil and/or the second heating coil has a diameter less than a diameter of a wire material of the electrical pin.

In a preferred embodiment, the first heating coil and the second heating coil of the heating portion are connected in parallel.

In a preferred embodiment, the vaporizer further includes:

a first support arranged close to the second surface of the first liquid guide element in the longitudinal direction of the outer housing, and configured to at least partially accommodate and retain the second liquid guide element, where the heating element is configured to retain the electrical pin on the first support and to keep the heating portion out of contact with the first support.

In a preferred embodiment, the air inlet end of the smoke output tube is provided with a first notch; and the first support is provided with a first convex edge at least partially extending into the first notch, and a capillary channel is defined between the first convex edge and the first notch to introduce an aerosol condensate in the first notch out of the smoke output tube.

In a preferred embodiment, the smoke output tube is configured to have a substantially oval cross section; the smoke output tube has a width direction parallel to an extension direction of the first portion and a thickness direction perpendicular to the width direction, and a width dimension of the smoke output tube is greater than a thickness dimension of the same; and the first notch is located on at least one side in the thickness direction of the smoke output tube.

In a preferred embodiment, the air inlet end of the smoke output tube is further provided with a second notch located in the width direction of the smoke output tube.

In a preferred embodiment, a width of the second notch is less than a width of the first notch.

In a preferred embodiment, the vaporizer further includes:

an air channel providing a flowing path for air to enter the liquid storage chamber.

In a preferred embodiment, the outer housing is internally provided with: an inner wall defining the liquid storage chamber configured to store a liquid substrate; and the air channel includes a first channel portion formed between the first liquid guide element and the inner wall.

In a preferred embodiment, the first liquid guide element has a peripheral side wall extending between the first surface and the second surface, the peripheral side wall has a straight portion adjacent to the inner wall, and a gap is retained between the straight portion and the inner wall to form the first channel portion.

In a preferred embodiment, the inner wall is provided with a second convex edge extending in the longitudinal direction of the outer housing, and a gap is retained between the first liquid guide element and the inner wall by abutting the second convex edge against the first liquid guide element to form the first channel portion.

In a preferred embodiment, the first liquid guide element has a peripheral side wall extending between the first surface and the second surface; and the peripheral side wall has a straight portion close to the second convex edge, and a gap is retained between the first liquid guide element and the inner wall by making the straight portion abut against the second convex edge to form the first channel portion.

In a preferred embodiment, the first channel portion substantially extends in the longitudinal direction of the outer housing.

In a preferred embodiment, the vaporizer further includes:

a first support arranged close to the second surface of the first liquid guide element in the longitudinal direction of the outer housing, and configured to at least partially define a vaporization chamber surrounding the second liquid guide element and/or the heating element; and the air channel further includes a second channel portion allowing air in the vaporization chamber to enter the first channel portion, the second channel portion being at least partially formed between the first support and the first liquid guide element.

In a preferred embodiment, the second liquid guide element is at least partially exposed to the second channel portion to allow the liquid substrate seeping out via the air channel to be sucked by the second liquid guide element.

In a preferred embodiment, the second channel portion extends in an extension direction different from the first channel portion, and preferably, the second channel portion is substantially perpendicular to the first channel portion.

In a preferred embodiment, the second channel portion is substantially perpendicular to the first channel portion.

In a preferred embodiment, the first support is provided with a groove adjacent to the second surface of the first liquid guide element, and the second channel portion is defined by the groove.

In a preferred embodiment, the groove is at least partially curved.

In a preferred embodiment, the groove at least partially surrounds the second liquid guide element.

In a preferred embodiment, the vaporizer further includes:

a first support arranged close to the second surface of the first liquid guide element in the longitudinal direction of the outer housing, and configured to at least partially define a vaporization chamber surrounding the second liquid guide element and/or the heating element; and the air channel is at least partially formed between the first support and the first liquid guide element.

In a preferred embodiment, the vaporizer further includes: a liquid buffer space configured to buffer the liquid substrate to adjust the efficiency of transferring the liquid substrate to the heating element.

In a preferred embodiment, the vaporizer further includes:

a liquid buffer space, at least partly surrounding the second liquid guide element and avoiding the portion of the first portion surrounded by the heating element, configured to store the liquid substrate to adjust the efficiency of transferring the liquid substrate to the portion of the first portion surrounded by the heating element.

In a preferred embodiment, the liquid buffer space includes at least one first capillary groove; and the first capillary groove is arranged to at least partially contact with the first portion, and is positioned on at least one side of the heating element in the extension direction of the first portion.

In a preferred embodiment, the first capillary groove is arranged to be perpendicular to the extension direction of the first portion.

In a preferred embodiment, the vaporizer further includes:

a first support configured to at least partially accommodate and retain the first portion; and the first capillary groove is arranged on a surface of the first support adjacent to the first portion.

In a preferred embodiment, the liquid buffer space includes a barrier chamber extending in the longitudinal direction of the outer housing, the barrier chamber being configured to at least partially surround the second portion.

In a preferred embodiment, the vaporizer further includes:

a first support configured to at least partially accommodate and retain the second portion; and the first support is provided with a window or hollow part adjacent to the second portion, and the barrier chamber is defined by the window or the hollow part.

In a preferred embodiment, a length of the barrier chamber extending in the longitudinal direction of the outer housing is less than ½ the extension length of the second portion.

In a preferred embodiment, the liquid buffer space further includes a second capillary groove arranged surrounding the second portion.

In a preferred embodiment, the second capillary groove is arranged to be parallel to the extension direction of the second portion.

In a preferred embodiment, the second portion has a liquid suction end close to the liquid storage chamber, and the second capillary groove is close to the liquid suction end.

In a preferred embodiment, the vaporizer further includes:

a second support, accommodated in the first support, and at least partially accommodating and retaining the second portion; and the liquid buffer space further includes a third capillary groove arranged on a surface of the second support adjacent to the second portion.

Another embodiment of this application further provides a vaporizer, configured to vaporize a liquid substrate to generate an aerosol, including an outer housing, where the outer housing is internally provided with:

a liquid storage chamber, configured to store a liquid substrate;

a second liquid guide element, including a first portion extending in a direction perpendicular to a longitudinal direction of the outer housing, and a second portion extending from the first portion to the liquid storage chamber in the longitudinal direction of the outer housing, where the second portion is configured to be in fluid communication with the liquid storage chamber to suck the liquid substrate; and a heating element at least partially surrounding the first portion, and being configured to heat at least part of the liquid substrate in the second liquid guide element to generate an aerosol, where the heating element includes a heating portion and an electrical pin for supplying power to the heating portion; the electrical pin includes an annular supporting portion having at least one turn, the annular supporting portion being configured to at least partially support the second liquid guide element by surrounding the first portion.

In a preferred embodiment, the vaporizer further includes:

a first support, configured to at least partially define a vaporization chamber surrounding the first portion and/or the heating element; and the heating element is configured to retain the electrical pin on the first support and to keep the heating portion out of contact with the first support.

Another embodiment of this application further provides an electronic vaporization device, including a vaporizer configured to vaporize a liquid substrate to generate an aerosol, and a power supply assembly configured to supply power to the vaporizer. The vaporizer includes the vaporizer described above.

BRIEF DESCRIPTION OF THE DRAWINGS

One or more embodiments are exemplarily described with reference to the corresponding figures in the accompanying drawings, and the descriptions are not to be construed as limiting the embodiments. Elements in the accompanying drawings that have same reference numerals are represented as similar elements, and unless otherwise particularly stated, the figures in the accompanying drawings are not drawn to scale.

DETAILED DESCRIPTION

For ease of understanding of this application, this application is described below in more detail with reference to the accompanying drawings and specific implementations.

Figure 1:
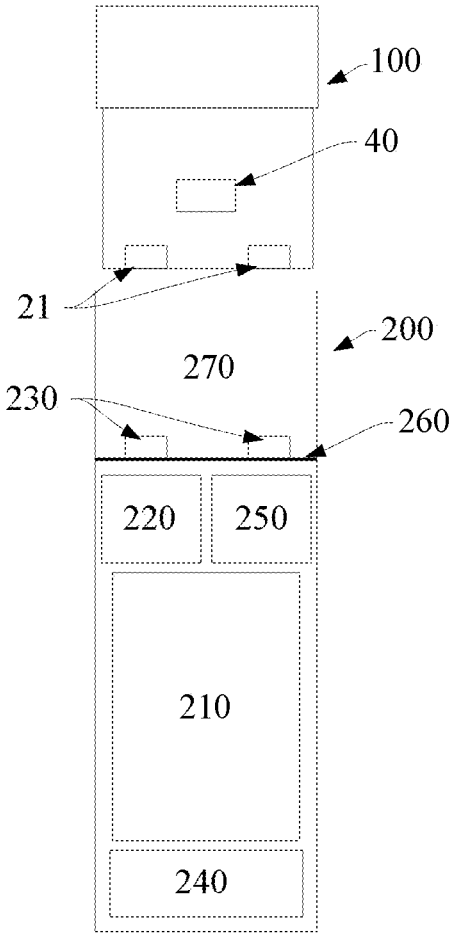
FIG. 1 is a schematic structural diagram of an electronic vaporization device according to an embodiment of this application.

An embodiment of this application provides an electronic vaporization device. Referring to FIG. 1, the electronic vaporization device includes: a vaporizer 100, configured to store a liquid substrate and vaporize the liquid substrate to generate an aerosol; and a power supply assembly 200, configured to supply power to the vaporizer 100.

In an optional embodiment, as shown in FIG. 1, the power supply assembly 200 includes: a receiving chamber 270, provided at an end in a length direction and configured to receive and accommodate at least part of the vaporizer 100; and a first electrical contact 230, at least partially exposed on a surface of the receiving chamber 270, and configured to be electrically connected to the vaporizer 100 when at least part of the vaporizer 100 is received and accommodated in the power supply assembly 200, to supply power to the vaporizer 100.

According to a preferred embodiment shown in FIG. 1, a second electrical contact 21 is provided on an end portion of the vaporizer 100 opposite to the power supply assembly 200 in the length direction, so that when at least part of the vaporizer 100 is received in the receiving chamber 270, the second electrical contact 21 contacts with and abuts against the first electrical contact 230 to form conductivity.

A seal member 260 is arranged in the power supply assembly 200, and at least part of an internal space of the power supply assembly 200 is separated by the seal member 260 to form the foregoing receiving chamber 270. In the preferred embodiment shown in FIG. 1, the seal member 260 is configured to extend along a cross section of the power supply assembly 200, and is preferably prepared by a flexible material, to prevent the liquid substrate seeping from the vaporizer 100 to the receiving chamber 270 from flowing to components such as a controller 220 and a sensor 250 inside the power supply assembly 200.

In the preferred embodiment shown in FIG. 1, the power supply assembly 200 further includes: a battery cell 210, located at the other end facing away from the receiving chamber 270 in the length direction, and configured to supply power; and a controller 220, arranged between the battery cell 210 and an accommodating chamber, and operably guiding a current between the battery cell 210 and the first electrical contact 230.

During use, the power supply assembly 200 includes a sensor 250, configured to sense an inhalation airflow generated by a suction nozzle cap 20 of the vaporizer 100 during inhalation, so that the controller 220 controls, according to a detection signal of the sensor 250, the battery cell 210 to output the current to the vaporizer 100.

Further, in the preferred embodiment shown in FIG. 1, a charging interface 240 is provided on the other end of the power supply assembly 200 facing away from the receiving chamber 270, and is configured to charge the battery cell 210.

Figure 2:
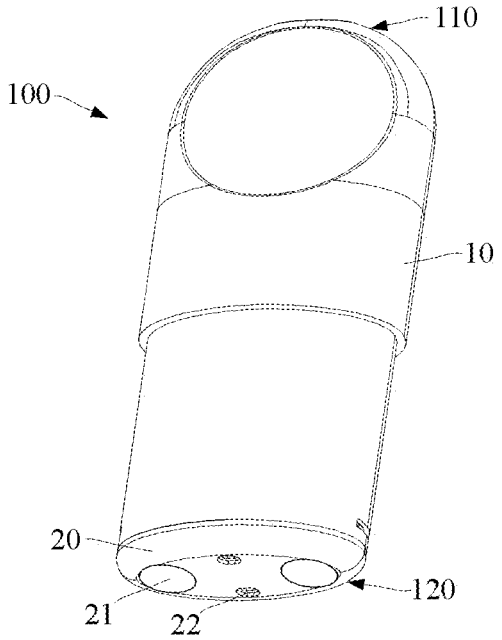
FIG. 2 is a schematic structural diagram of an embodiment of the vaporizer in FIG. 1.
Figure 3:
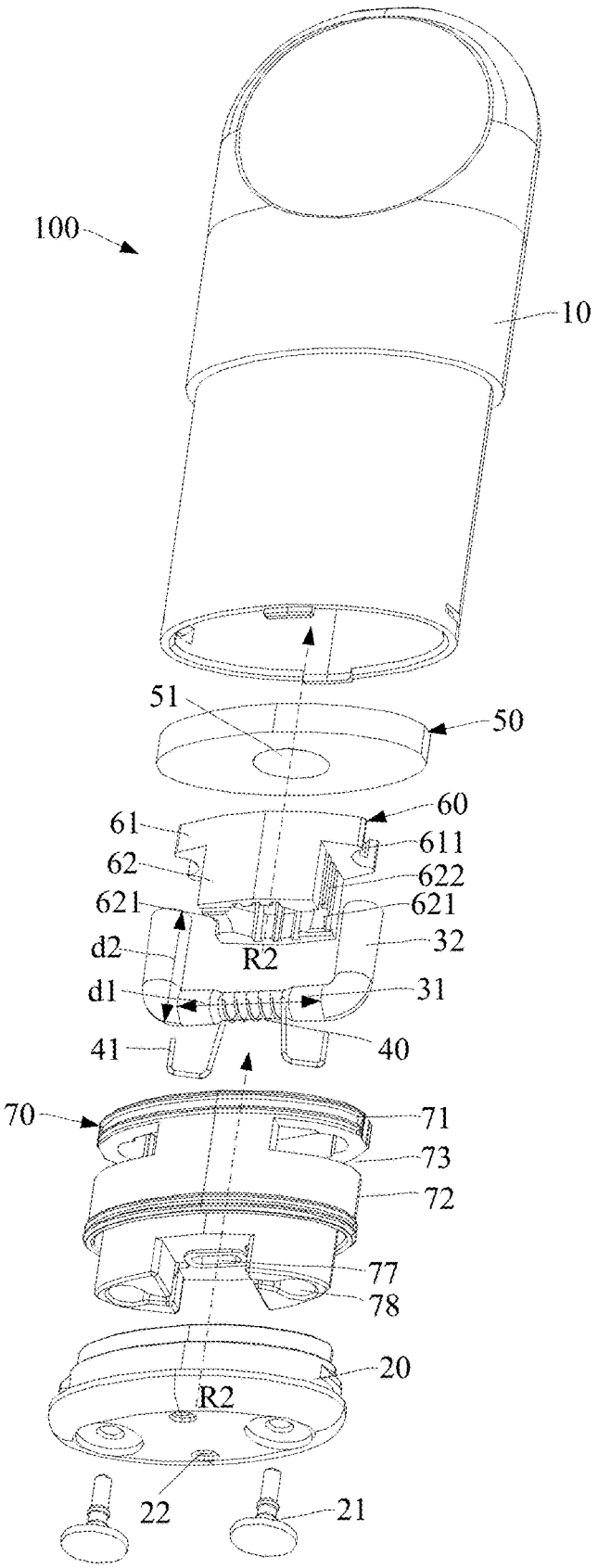
FIG. 3 is a schematic exploded view of the vaporizer shown in FIG. 2 from a perspective.

The embodiments in FIG. 2 to FIG. 5 are schematic structural diagrams of the vaporizer 100 in FIG. 1 according to an embodiment. The vaporizer includes:

a main housing 10; As shown in FIG. 2 and FIG. 3, the main housing 10 is substantially in a flat cylindrical shape, and certainly, the main housing is hollow inside to accommodate necessary functional components configured to store and vaporize the liquid substrate. The main housing 10 has a near end 110 and a far end 120 opposite to each other in the length direction. According to requirements for common use, the near end 110 is configured as an end for a user to inhale the aerosol, and a suction nozzle A for the user to inhale is arranged at the near end 110; and the far end 120 is used as an end combined with the power supply assembly 200, and the far end 120 of the main housing 10 is an opening on which a detachable end cap 20 is mounted. The opening is configured to mount necessary functional components inside the main housing 10.

Further, in a specific embodiment shown in FIG. 2 to FIG. 3, the second electrical contact 21 runs through the surface of the end cap 20 into the vaporizer 100, so that at least part of the second electrical contact is exposed outside the vaporizer 100, so as to form conductivity through contact with the first electrical contact 230. In addition, the end cap 20 is further provided with a first air inlet 22, configured to supply external air into the vaporizer 100 during inhalation. Further referring to FIG. 3, certainly, the second electrical contact 21 is flush with the surface of the end cap 20 after assembly.

Figure 4:
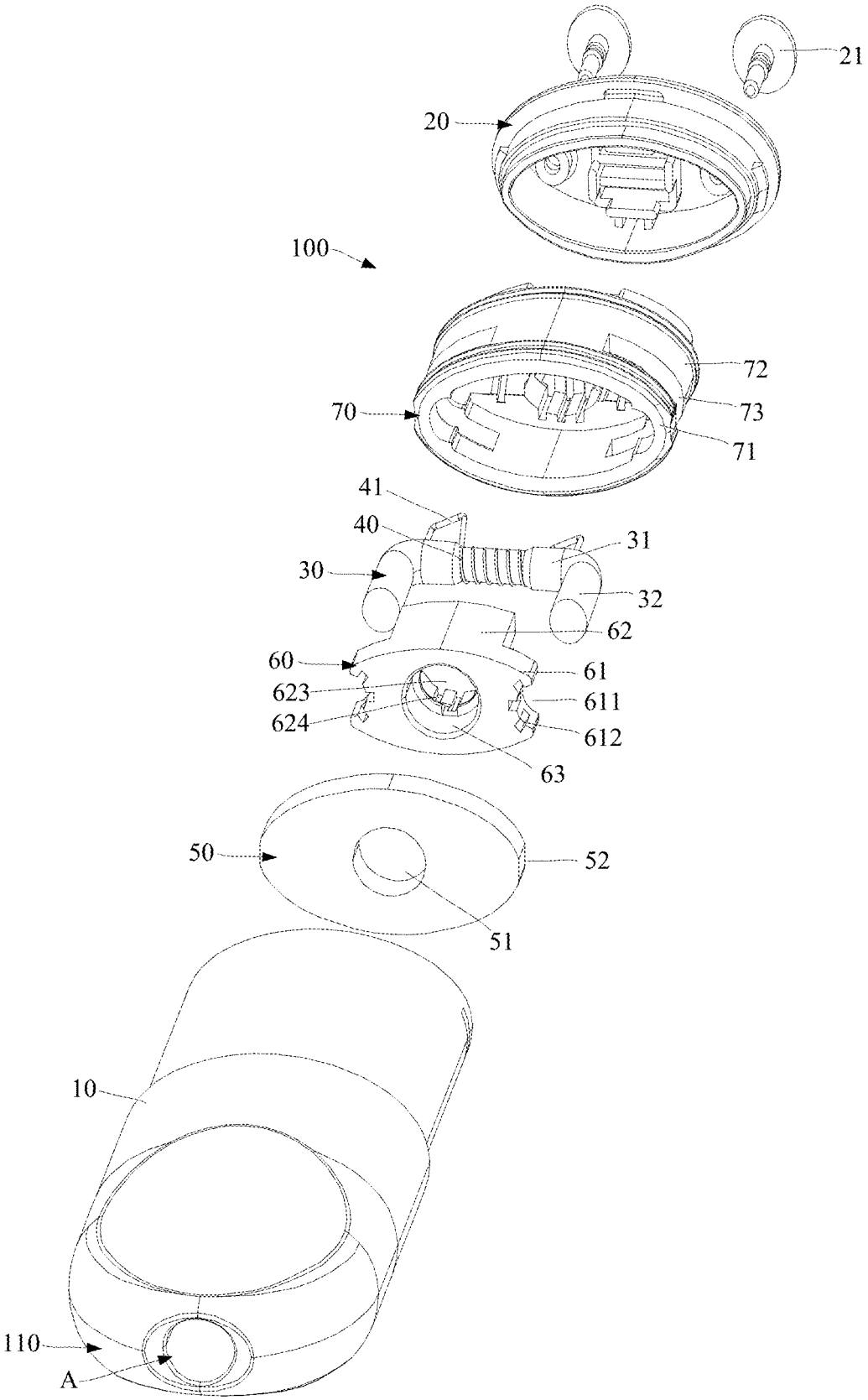
FIG. 4 is a schematic exploded view of the vaporizer shown in FIG. 2 from still another perspective.
Figure 5:
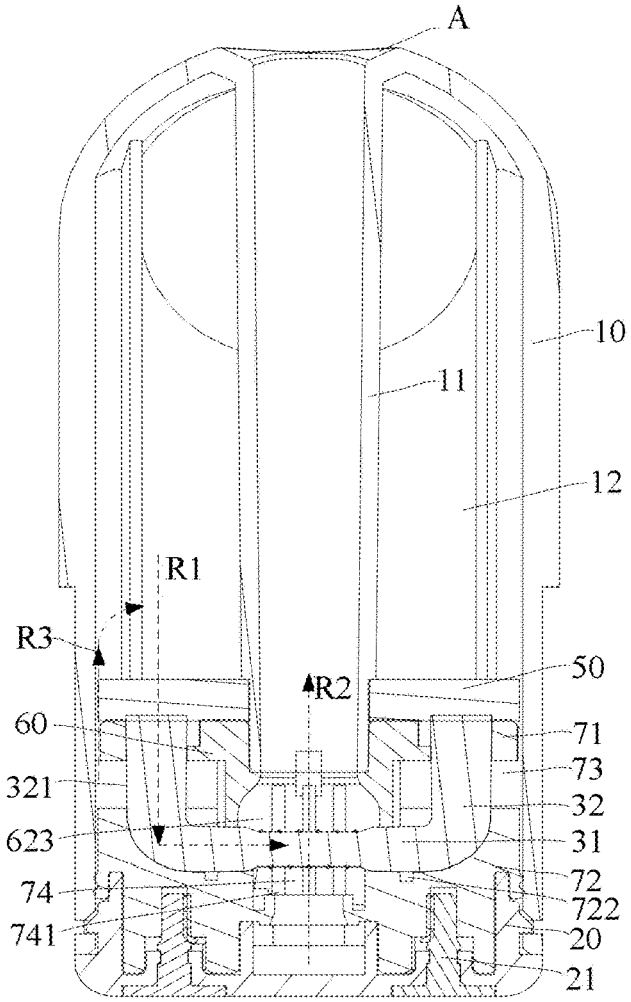
FIG. 5 is a schematic cross-sectional view of the vaporizer shown in FIG. 2 in a width direction.

Further referring to FIG. 3 to FIG. 5, the main housing 10 is internally provided with a liquid storage chamber 12 for storing the liquid substrate, and a vaporization assembly for sucking the liquid substrate from the liquid storage chamber 12, and heating and vaporizing the liquid substrate. In a cross-sectional structural diagram shown in FIG. 5, a smoke transfer tube 11 in an axial direction is arranged inside the main housing 10, and the liquid storage chamber 12 configured to store the liquid substrate is formed in a space between an outer wall of the smoke transfer tube 11 and an inner wall of the main housing 10. A first end of the smoke transfer tube 11 opposite to the near end 110 is in communication with the suction nozzle A, so that an aerosol generated is transferred to the suction nozzle A for inhalation.

Further, as shown in the figure, the smoke transfer tube 11 and the main housing 10 are molded integrally with a moldable material, and the liquid storage chamber 12 formed after preparation is open or opened towards the far end 120.

In FIG. 3 to FIG. 5, the vaporization assembly includes: a second liquid guide element 30, and a heating element 40 configured to heat and vaporize the liquid substrate sucked by the second liquid guide element 30. Specifically, the second liquid guide element 30 is made from flexible strip-shaped or rod-shaped fiber materials, such as cotton fibers, non-woven fibers, sponge, etc. During assembly, the second liquid guide element 30 is configured to be in a U shape, including a first portion 31 extending in a width direction of the main housing 10, and a second portion 32 extending from the two side ends of the first portion 31 to the liquid storage chamber 12 in the longitudinal direction of the outer housing 10. During use, the second portion 32 is configured to suck the liquid substrate and transfer the liquid substrate to the first portion 31 after the liquid substrate is infiltrated by capillaries. The heating element 40 is configured to at least partially surround the first portion 31, and to heat at least part of the liquid substrate in the first portion 31 to generate an aerosol. As shown in FIG. 3 to FIG. 5, the heating element 40 is of a structure of a spiral heating wire and may be made from resistive metals such as Fe—Cr—Al alloy, Ni—Cr alloy, etc.

In an optional embodiment, the second liquid guide element 30 in FIG. 3 has a first portion 31 with an extension length d1 of about 9 mm, and a second portion 32 with an extension length d2 of about 7.5 mm. The inner diameter of the heating element 40 is approximately within a range of 2.3-2.6 mm.

Further, in a preferred embodiment shown in FIG. 3 to FIG. 5, the main housing 10 is further internally provided with a first liquid guide element 50; and the first liquid guide element 50 is a layer of flaky or blocky organic porous fiber extending along the cross section of the main housing 10. After assembly, the upper surface of the first liquid guide element 50 close to the liquid storage chamber 12 is opposite to the liquid storage chamber 12 and is configured to suck the liquid substrate, and the lower surface of the first liquid guide element facing away from the liquid storage chamber 12 is configured to transfer the liquid substrate to the second portion 32 of the second liquid guide element 30 in contact with the lower surface, as indicated by arrow R1 in FIG. 5. The first liquid guide element 50 is provided with a first insertion hole 51 for the smoke transfer tube 11 to run through.

Based on the assembly and fixation of the second liquid guide element 30 and the first liquid guide element 50, in the embodiments shown in FIG. 3 to FIG. 5, the main housing 10 is further internally provided with an inner support 60 and an outer support 70. Specifically, the outer support 70 is generally in a hollow cup shape or barrel shape, and the inner support 60 is accommodated and assembled in a hollow part of the outer support 70. Specifically, as shown in FIG. 4 and FIG. 5, the outer support 70 includes a first supporting portion 71 and a second supporting portion 72 opposite to each other in the longitudinal direction of the main housing 10, and a window or hollow part 73 between the two, where the first supporting portion 71 is close to the liquid storage chamber 12, and the second supporting portion 72 is close to the end cap 20. The inner support 60 has a first retaining portion 61 and a second retaining portion 62 opposite to each other in the longitudinal direction of the main housing 10, where the first retaining portion 61 is close to the liquid storage chamber 12, and the second retaining portion 62 is close to the end cap 20.

After assembly, the upper ends of the inner support 60 and the outer support 70 close to the liquid storage chamber 12 abut against or support the first liquid guide element 50; and the second liquid guide element 30 is clamped and held by the inner support 60 and the outer support 70 from the inner and outer sides, and the second liquid guide element 30 is held between the inner support 60 and the outer support 70.

Specifically, after assembly, in the longitudinal direction of the outer housing 10, the second retaining portion 62 and the second supporting portion 72 of the inner support 60 clamp the first portion 31 of the second liquid guide element 30 from the upper and lower sides, respectively. In addition, in the width direction of the outer housing 10, the first retaining portion 61 and the first supporting portion 71 of the inner support 60 clamp the second portion 32 of the second liquid guide element 30 from the inner and outer sides, respectively.

Figure 7:
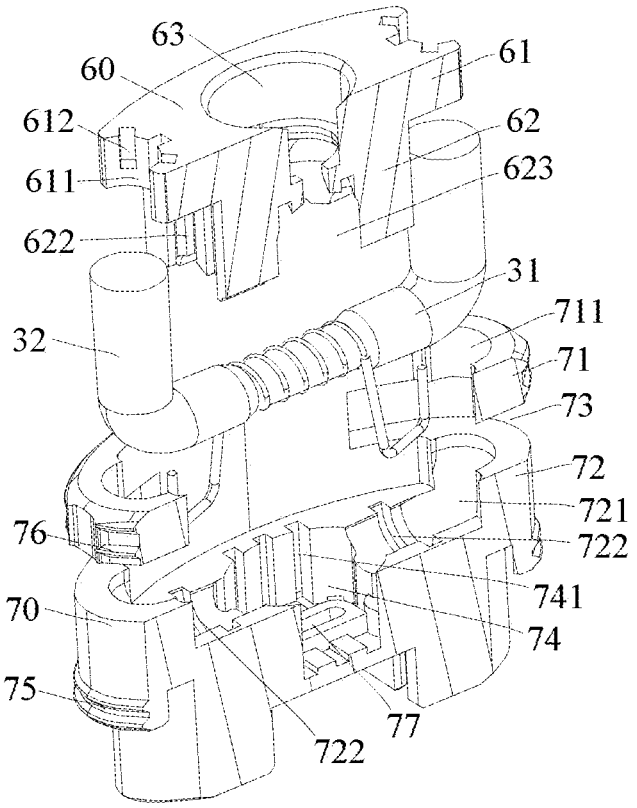
FIG. 7 is a cross-sectional view of the first liquid guide element, the inner support and the outer support shown in FIG. 6 in an exploded state.

In the preferred embodiment shown in FIG. 7, the outer support 70 is preferably made from flexible materials such as silica gel and thermoplastic elastomers, and a first convex rib 76 extending in the circumferential direction is provided on the outer wall of the first supporting portion 71; and/or a second convex rib 75 extending axially is provided on the outer wall of the second supporting section 72. During implementation, the first convex rib 76 and the second convex rib 75 are configured to seal the gap between the outer support 70 and the main housing 10. The inner support 60 is made from flexible or rigid materials.

Figure 6:
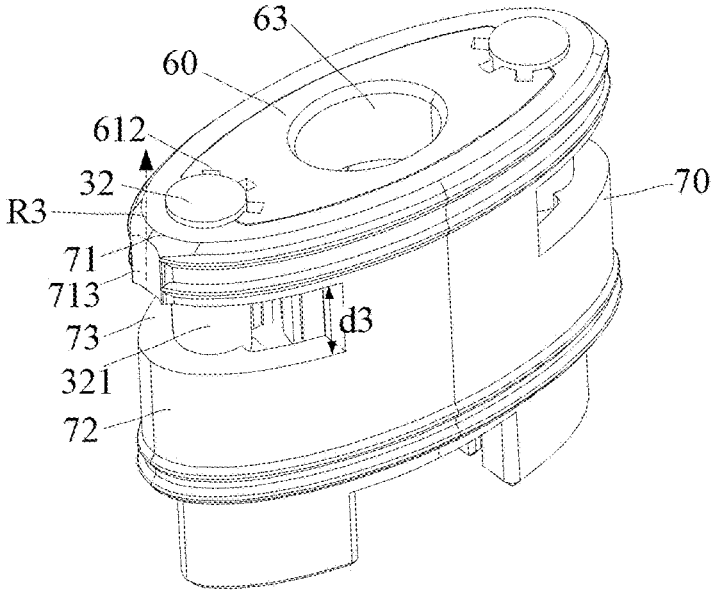
FIG. 6 is a schematic diagram of the first liquid guide element in FIG. 3 after being assembled on an inner support and an outer support.
Figure 8:
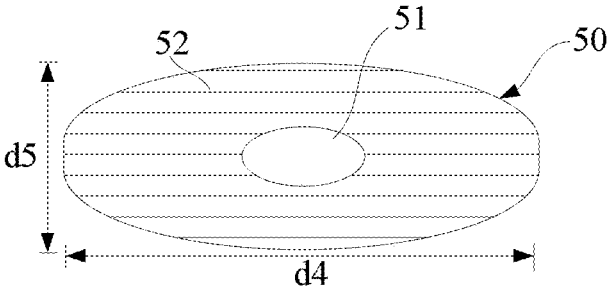
FIG. 8 is a schematic diagram of the second liquid guide element from still another perspective.

Further, according to the preferred embodiment shown in FIG. 6 to FIG. 8, the inner support 60 has a first clamping port 611 located on both sides in the width direction, and the first supporting portion 71 of the outer bracket 70 has a second clamping portion 711; and after assembly, the second portion 32 of the second liquid guide element 30 is clamped by the first clamping port 611 and the second clamping port 711 respectively from both sides.

Referring also to FIG. 3, the lower end of the second retaining portion 62 of the inner support 60 is provided with a U-shaped third clamping port 621, which in turn presses the first portion 31 against the inner bottom wall of the second supporting portion 72.

The state after assembly is shown in FIG. 5 and FIG. 6. The window or hollow part 73 is arranged close to both sides of the outer support 70 in the width direction, and at least partly surrounds the second portion 32, so that at least part of the second portion 32 is exposed to the outer support 70. Furthermore, the exposed portion of the second portion 32 is a suspension portion 321 that is out of contact with both the outer support 70 and the inner support 60. A barrier space is formed on the periphery of the suspension portion 321, thereby preventing the liquid substrate from flowing or transferring rapidly to the first portion 31 along the surface of the suspension portion 321. In an optional embodiment, the dimension or distance d3 of the window or hollow part 73 in FIG. 6 in the longitudinal direction is designed to be 2-4 mm, preferably 2.3 mm; and does not exceed ½ the length of the second portion 32 of the second liquid guide element 30.

Further, according to FIG. 4 to FIG. 7, a plurality of first capillary grooves 612 extending in the longitudinal direction are provided on the surface of the first clamping port 611. Similarly, a second capillary groove 622 is provided on the outer side wall of the second retaining portion 62 of the inner support 60 adjacent to the second portion 32, especially the suspension portion 321. After assembly, the first capillary groove 612 and/or the second capillary groove 622 are configured to suck and buffer the liquid substrate, which can also adjust the efficiency of the liquid substrate flowing on the surface of the second portion 32.

The design of a gas path for the release and output of aerosols is shown in FIG. 5 to FIG. 7. A first cavity 623 of the second supporting portion 72 facing the outer support 70 in the longitudinal direction is formed in the second retaining portion 62 of the inner support 60, and a second cavity 74 of the second retaining portion 62 facing the inner support 60 is correspondingly provided on the second supporting portion 72 of the outer bracket 70. After assembly, the first cavity 623 and the second cavity 74 cooperate with each other to define a vaporization chamber surrounding the heating element 40 and/or the first portion 31, and the aerosol generated by the heating element 40 is released into the vaporization chamber.

A second air inlet 77 is provided on the wall of the outer support 70 facing the end cap 20, thereby allowing external air to enter the vaporization chamber via the first air inlet 22 of the end cap 20 during inhalation. In addition, the first retaining portion 61 of the inner support 60 is provided with a second insertion hole 63 for connection and assembly of the smoke transfer tube 11. After assembly, the aerosol generated in the vaporization chamber is carried by air entering the vaporization chamber via the second air inlet 77 is output by the smoke transfer tube 11, as indicated by arrow R2 in FIG. 3.

In order to facilitate power supply of the heating element 40, the side of the outer support 70 facing the end cap 20 is also provided with a contact hole 78 for at least partially accommodating and retaining the second electrical contact 21; and pins 41 on both ends of the heating element 40 run into the contact hole 78, and then achieve conduction with the second electrical contact 21 by abutting or welding.

A capillary structure for sucking aerosol condensate is further provided in the vaporization chamber. For example, as shown in FIG. 5, the capillary structure includes a third capillary groove 741 positioned on the inner wall of the second cavity 74, and configured to suck and retain the aerosol condensate in the vaporization chamber under capillary action. Alternately, in other variable embodiments, the capillary structure further includes a fourth capillary groove 624 formed on the inner wall of the first cavity 621.

In the foregoing embodiments, the first capillary groove 612 and/or the second capillary groove 622 and/or the third capillary groove 741 and/or the fourth capillary groove 624 each have a width of about 0.5 mm and a depth of about 0.5 mm.

In a still more preferred embodiment, as shown in FIG. 7, the second supporting portion 72 of the outer support 70 is internally provided with an assembly chamber 721 adapted to the shape of the first portion 31 of the second liquid guide element 30, which is configured to assist the positioning of the second liquid guide element 30 in the outer support 70. In the meanwhile, a fifth capillary groove 722 extending in the thickness direction of the main housing 10 is arranged on the wall of the assembly chamber 721. The fifth capillary groove 722 is located on both sides of the heating element 40 or the portion of the first portion 31 surrounded by the heating element 40 in the width direction of the main housing 10. Finally, a gap or space is formed between the part close to the vaporization area heated by the heating element 40*a* and the first portion 31, which is configured to suck and buffer the liquid substrate and prevent the liquid substrate from being transferred directly and quickly to the portion surrounded by the heating element 40*a* to alleviate the situation that E-liquid is suddenly blown off.

In an optional embodiment, the fifth capillary groove 722 is designed to have a width of 0.5 mm and a depth of 0.46 mm.

In still another preferred embodiment, the first liquid guide element 50 is made from an organic porous material with elasticity, which shows moderate flexibility and rigidity. In an embodiment, the first liquid guide element 50 has an elastic modulus or stiffness of a material smaller than that of the material of the main housing 10 or a defined liquid storage chamber 12 and larger than that of the material of the second liquid guide element 30. Specifically, the material is hard staple rayon with a Shore hardness of 20-70 A. In an optional embodiment, the first liquid guide element 50 is made from hard staple rayon including oriented polyester fibers or hard artificial or artificial foam made from filamentous polyurethane. The above first liquid guide element 50 has hardness or flexibility between the common flexible vegetable cotton/non-woven fabric (shore hardness less than 20 A) and rigid porous ceramics/microporous metals (shore hardness greater than 80 A), so that the structure is stable and expands little after sucking and infiltrating itself with the liquid substrate. After assembly, the first liquid guide element 50 is in contact (between flexible contact and rigid contact) with the inner wall of the outer housing 10 and/or the tube wall of the smoke output tube 11. On one hand, it can independently seal the liquid storage chamber 12 by its own flexibility, on the other hand, it has a certain hardness, which allows the first liquid guide element to be easily fixed and retained. Specifically, according to the foregoing figure, the shape of the first liquid guide element 50 is substantially matched with the opening in the lower end of the liquid storage chamber 12, so as to cover, block and seal the liquid storage chamber 12.

In a more preferred embodiment, the first liquid guide element 50 has a Shore hardness 50-70 A, which is approximately equal to that of a thermoplastic elastomer or silica gel.

Figure 9:
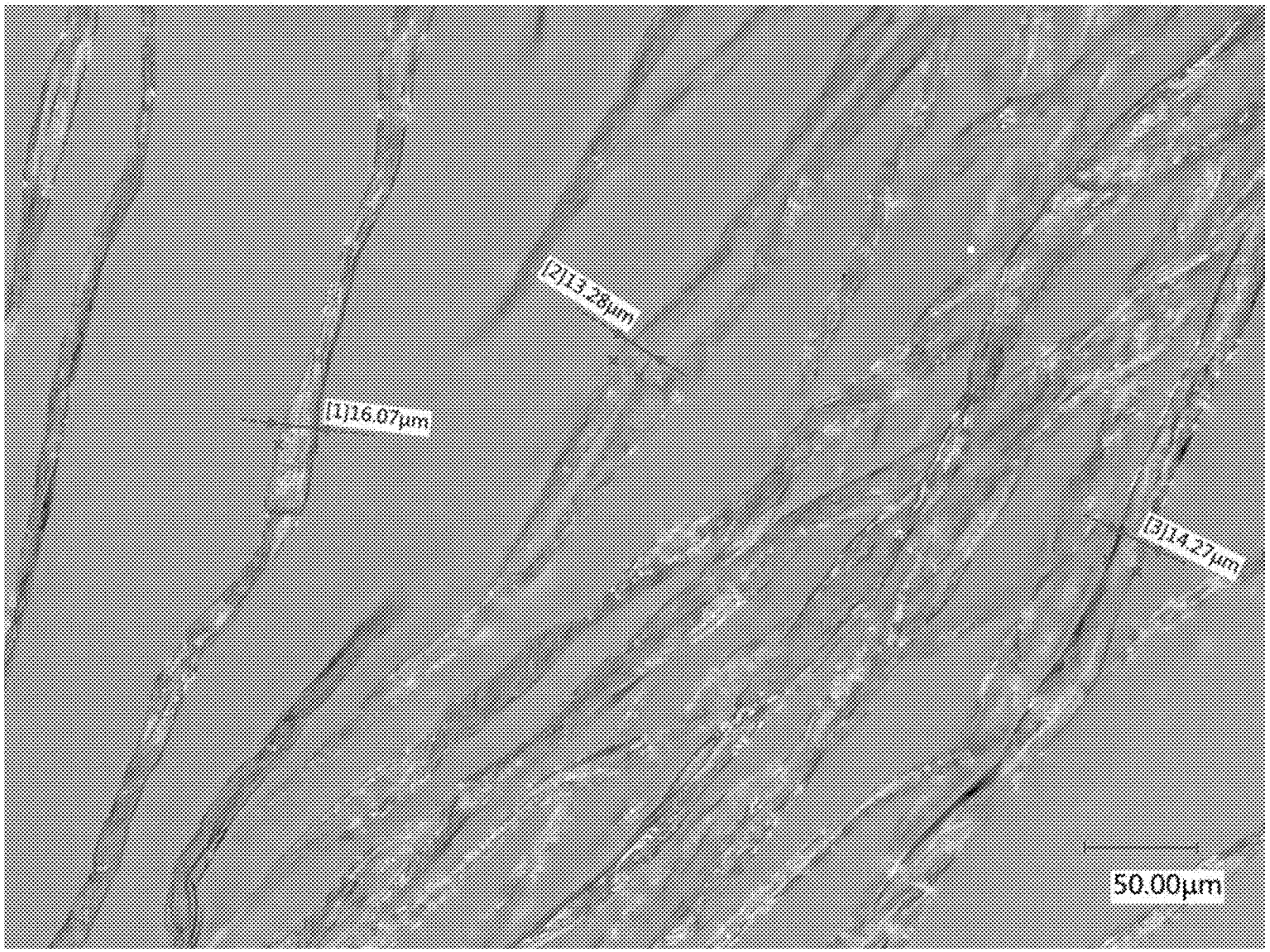
FIG. 9 is a microscope electron micrograph of oriented fibers for preparing the second liquid guide element.

FIG. 8 shows a schematic diagram of the shape of the surface or cross section of the first liquid guide element 50 with the above hardness. The first liquid guide element 50 is roughly in an oval shape, and the first insertion hole 51 matched with the smoke transfer tube 11 is also in an oval shape. The first liquid guide element 50 is made from oriented fibers such as polyethylene and/or polypropylene fibers substantially arranged in a length direction. For example, FIG. 9 shows a micrograph of polypropylene fibers with an oriented arrangement in one embodiment. Through the arrangement of the oriented fibers in the length direction of the first liquid guide element 50, the first liquid guide element 50 shows strong bending resistance and then high rigidness. The first liquid guide element 50 is prepared from the above organic fibers. In the preparation process, sufficient gaps are retained between the fiber materials, which can not only transfer the liquid substrate, but also give the first liquid guide element 50 appropriate flexibility. The first liquid guide element 50 having the foregoing oriented fibers is anisotropic. Specifically, in one aspect, the flexural strength in the length direction is greater than the flexural strength in the width direction. Alternatively, in another aspect, the liquid guide rate in the length direction is greater than the liquid guide rate in the width direction.

In the meanwhile, in FIG. 8, a line 52 extending in the length direction is provided on the surface or in the first liquid guide element 50. Specifically, the line 52 is made from the foregoing oriented fibers by a textile process such as roller pressing, and during the preparation process, the spacing between some fibers is increased by roller pressing or hydroentanglement process, so as to form a dent visible to the naked eye at the position where the spacing is increased, and the width is less than 1 mm, and is about 0.1-0.5 mm. Furthermore, a line 52 is formed on the surface or inside of the first liquid guide element 50 by the above dents, which is beneficial for transmitting and retaining the liquid substrate and improving hardness.

In the first liquid guide element 50 shown in FIG. 8 of the above embodiment, the first liquid guide element 50 has a length d4 of 16.4 mm, a width d5 of 7.80 mm, and a thickness of 2.0 mm.

Further referring to FIG. 4 to FIG. 6, the vaporizer 100 also includes an air pressure balance channel for air to enter the liquid storage chamber 12, to supplement air into the liquid storage chamber 12 and thereby alleviate the negative pressure in the liquid storage chamber 12 caused by the consumption of the liquid substrate. Specifically, in an embodiment, in FIG. 6, a sunken structure 713 is provided on the side wall of the first supporting portion 71, thereby retaining a gap between the first supporting portion 71 and the inner wall of the outer housing 10. In addition, the two sides of the peripheral side wall of the first liquid guide element 50 are provided with a straight portion 52, so as to also retain a gap between the straight portion 52 of the first liquid guide element 50 and the inner wall of the outer housing 10. Furthermore, when the negative pressure in the liquid storage chamber 12 exceeds a certain threshold, the air in the window or hollow part 73 can, according to the arrow R3 in FIG. 5, run through the gap defined by the sunken structure 713 and the gap defined by the straight portion 52, and then enters the liquid storage chamber 12. Certainly, in the above embodiments, on one hand, the space in the window or hollow part 73 is communicated with the vaporization chamber through the gap between the second portion 32 and the inner support 60. On the other hand, the space in the window or hollow part 73 is communicated with the external atmosphere through the gap between the outer support 70 and the outer housing 10.

Figure 10:
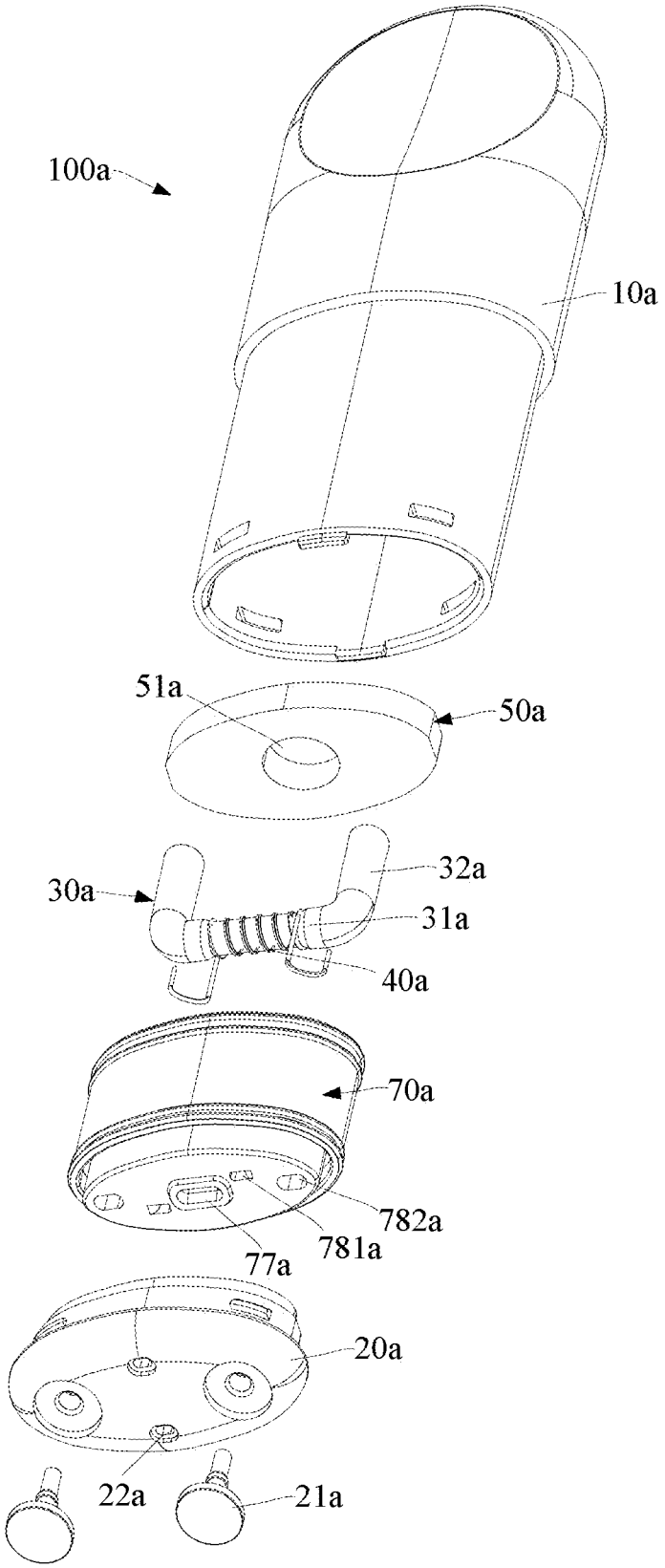
FIG. 10 is a schematic exploded view of a vaporizer of still another embodiment from a perspective.
Figure 11:
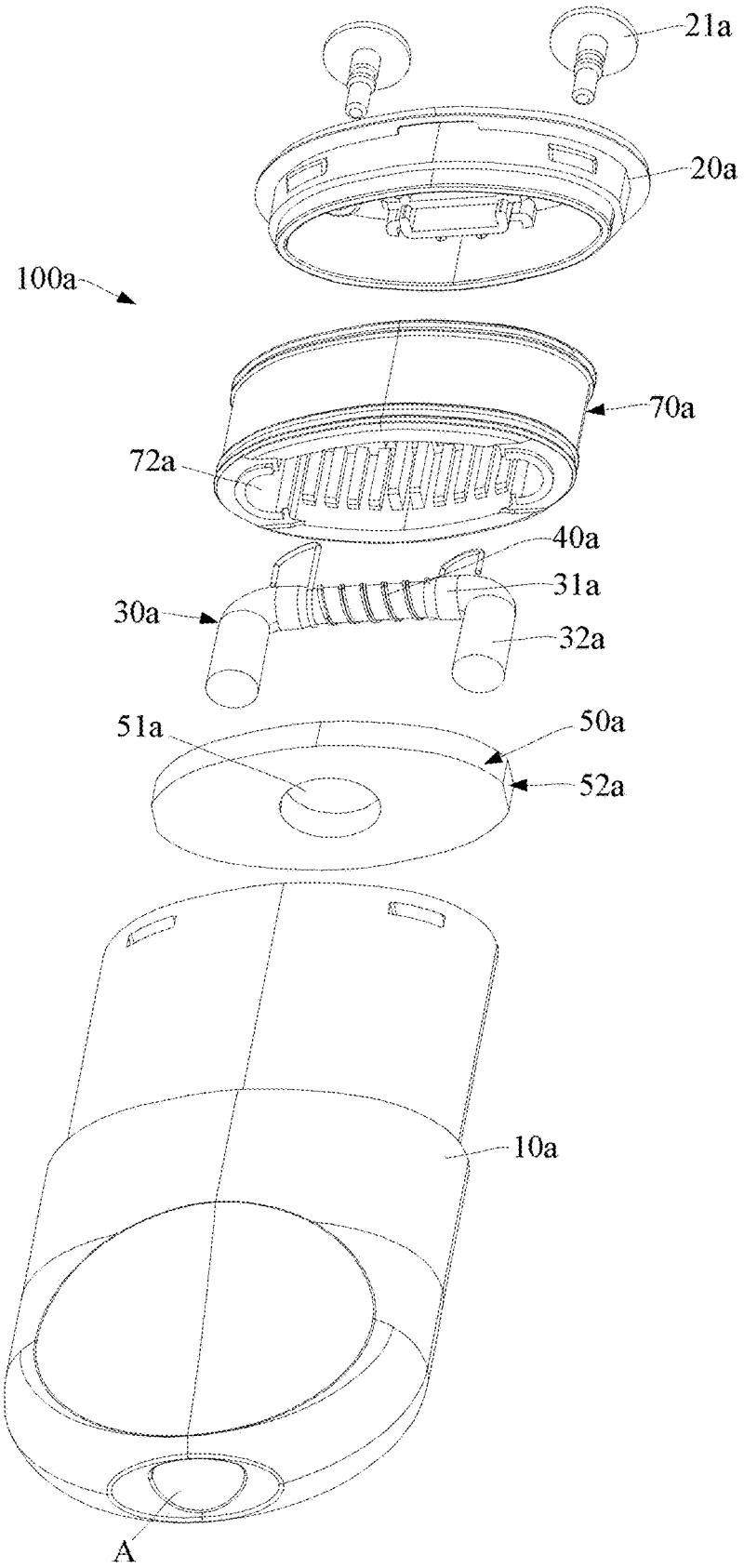
FIG. 11 is a schematic exploded view of the vaporizer shown in FIG. 10 from still another perspective.
Figure 12:
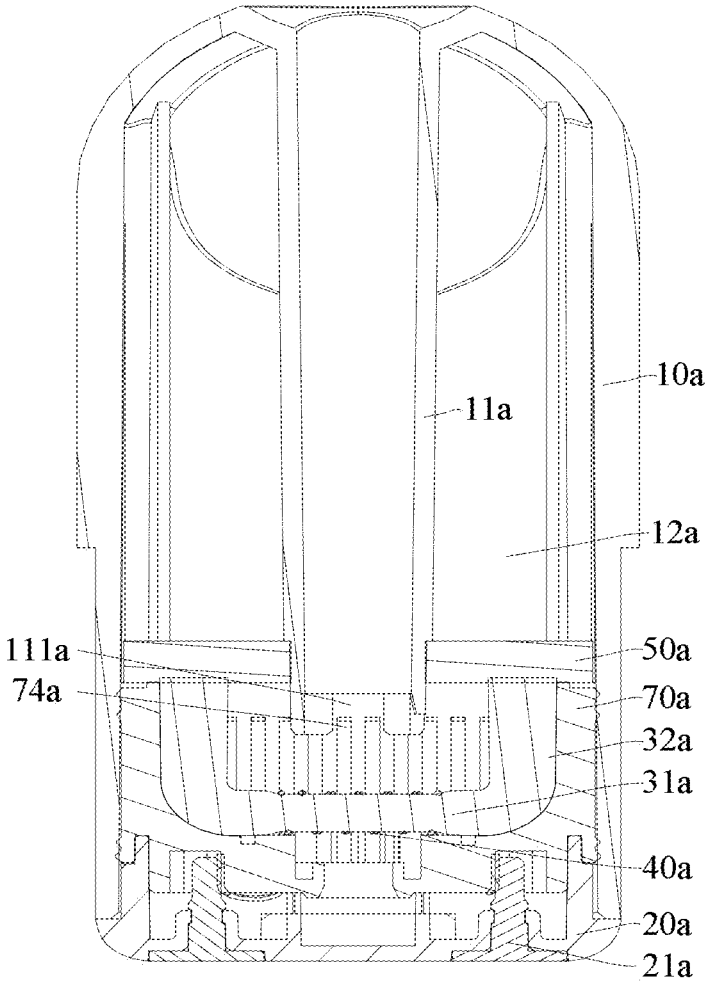
FIG. 12 is a schematic cross-sectional view of the vaporizer shown in FIG. 10 in a width direction.

FIG. 10 to FIG. 12 show a schematic diagram of a vaporizer 100*a* according to still another embodiment. The vaporizer includes:

- a main housing 10*a*, internally provided with a smoke output tube 11*a* extending longitudinally, and a liquid storage chamber 12*a* defined by the smoke output tube 11*a* and the inner wall of the main housing 10*a;*
- a second liquid guide element 30*a*, having a first portion 31*a* extending in the width direction of the main housing 10*a*, and a second portion 32*a* extending from the first portion 31*a* in the longitudinal direction of the main housing 10*a*, where the second portion 32*a* is in fluid communication with the liquid storage chamber 12*a* through the flaky or blocky first liquid guide element 50*a*, where the second liquid guide element 30*a* is made from conventional flexible vegetable cotton, and the first liquid guide element 50*a* is made from the above oriented fibers and has a hard shape;
- a heating element 40*a* surrounding at least part of the first portion 31*a*, and being configured to heat at least part of the liquid substrate in the first portion 31*a* to generate an aerosol;
- an outer support 70*a*, in a hollow cup shape or barrel shape, internally provided with a vaporization chamber 30*a* for retaining the second liquid guide element and defining the first portion 31*a*, where an aerosol generated by heating of the heating element 40*a* is released to the vaporization chamber and then output to the smoke output tube 11*a*; and in addition, the upper end of the outer support 70*a* close to the liquid storage chamber 12*a* supports the first liquid guide element 50*a*; and
- an end cap 20*a* configured to seal the open end of the main housing 10*a*, and provided with a second electrical contact 21*a* and a first air inlet 22*a*; and
- a second electrical contact 21*a* running through the end cap 20*a* into the vaporizer 100*a* for supplying power to the heating element 40*a*.

Figure 13:
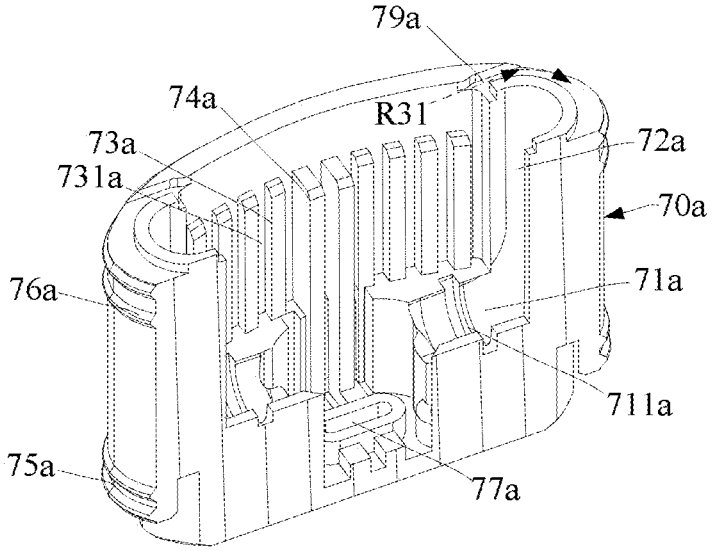
FIG. 13 is a schematic cross-sectional view of the outer support in FIG. 11 from still another perspective.

Further referring to FIG. 12 and FIG. 13, the retaining structure inside the outer support 70*a* for retaining the second liquid guide element 30*a* includes:

- a first retaining cavity 71*a* disposed on the inner bottom wall extending in the width direction of the main housing 10*a* for retaining the first portion 31*a* of the second liquid guide element 30*a*; and a second retaining cavity 72*a* extending in the longitudinal direction of the main housing 10*a* and configured to retain the second portion 32*a* of the second liquid guide element 30*a*.

In the meanwhile, a fifth capillary groove 711*a* extending in the thickness direction of the main housing 10*a* is arranged on the wall of the first retaining cavity 71*a*. The fifth capillary groove 711*a* is located on both sides of the heating element 40*a* or the portion of the first portion 31*a* surrounded by the heating element 40*a* in the width direction of the main housing 10. Finally, a gap or space is formed between the part close to the vaporization area heated by the heating element 40*a* and the first portion 31, which is configured to buffer the liquid substrate to prevent the liquid substrate from directly and quickly flowing to or being transferred to the portion surrounded by the heating element 40*a* to alleviate the situation that E-liquid is suddenly blown off.

Figure 18:
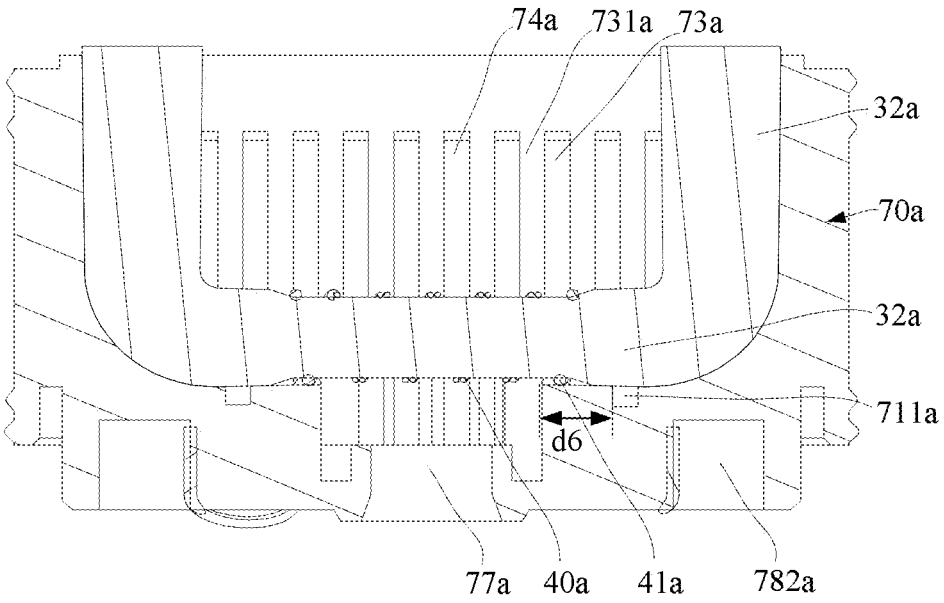
FIG. 18 is a schematic cross-sectional view of the first liquid guide element and the outer housing after assembly in FIG. 10.

After assembly, as shown in FIG. 18, the distance d6 between the fifth capillary groove 711*a* and the heating portion of the heating element 40*a*, namely the first spiral coil 410*a* and/or the second spiral coil 420*a*, in the width direction of the outer housing 10*a* is about 1.5 mm.

The first convex rib 75*a* and the second convex rib 76*a* extending in the circumferential direction are also arranged on the outer wall of the outer support 70*a* and configured to seal the gap between the outer support 70*a* and the main housing 10*a*. The first convex rib 75*a* is close to the end cap 20*a*, and the second rib 76*a* is close to the first liquid guide element 50*a*.

The outer support 70*a* is further provided with a second air inlet 77*a* facing the end cap 20*a*, which is configured to allow external air to enter the vaporization chamber inside the outer support 70*a* via the first air inlet 22*a*. In the embodiment shown in FIG. 13, a plurality of first convex edges 73*a* extending longitudinally are arranged on the inner wall of the outer support 70*a*, and a capillary groove 731*a* capable of sucking and retaining aerosol condensate in the vaporization chamber is formed between the first convex edges 73*a*. In this embodiment, the first convex edge 73*a* has a width of approximately 0.5-1.5 mm, and the capillary groove 731*a* has a width less than 2 mm.

In preferred embodiments shown in FIG. 12 to FIG. 14 and FIG. 16 and FIG. 17, the air inlet end of the smoke output tube 11*a* facing away from the suction nozzles A is provided with first notches 111*a*. Preferably, two first notches 111*a* are arranged opposite to each other in the thickness direction of the main housing 10*a*. Second convex edges 74*a* at least partially extending in the first notches 111*a* are arranged in the outer support 70*a* in cooperation with the first notches 111*a*. After assembly, the two side surfaces of the second convex edge 74*a* are not in contact with the two side surfaces of the first notch 111*a*, and as shown in FIG. 2, a certain distance is kept between the second convex edge 74*a* and the two side surfaces of the first notch 111*a*. Furthermore, the space is controlled to be lower than 2 mm, so that a capillary channel with capillary action is formed between the second convex edge and the first notch. Under the capillary force of the capillary channel, the condensate in the smoke output tube 11*a* falling or flowing to the air inlet end is sucked and guided to the vaporization chamber of the outer support 70*a*, so as to prevent the situation that condensate is accumulated in the smoke output tube 11*a* to form a liquid column, and alleviate or eliminate the problem that the condensate is sucked.

According to FIG. 13, in order to ensure that the second convex edge 74*a* can extend into the first notch 111*a* of the smoke output tube 11*a*, the second convex edge 74*a* has a projection height greater than that of the first convex edge 73*a*, and a width the same as that of the first convex edge 73*a*.

Figure 14:
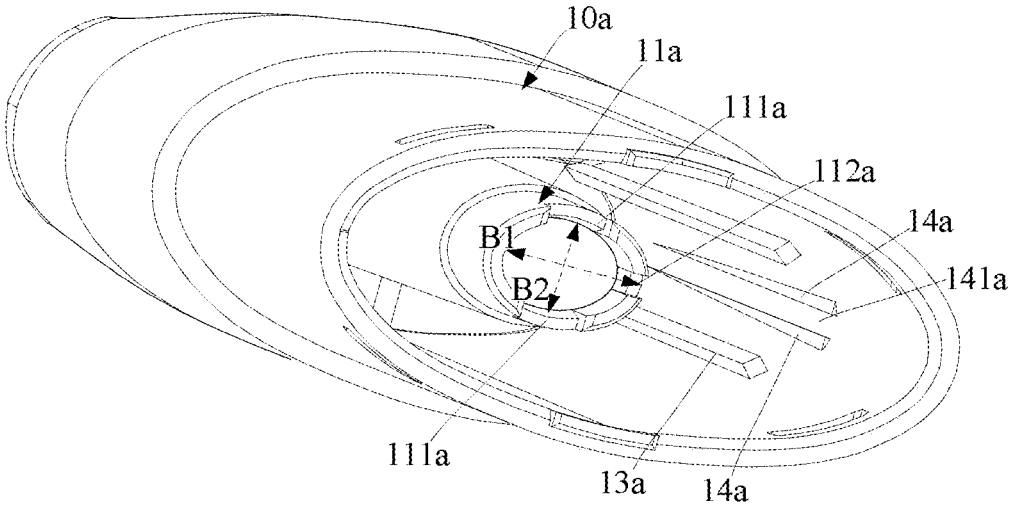
FIG. 14 is a schematic diagram of a main housing in FIG. 10 from still another perspective.

In the embodiment shown in FIG. 14, the cross section of the smoke output tube 11*a* is in an oval shape; and the oval shape takes the width direction of the main housing 10*a* as the long axis B1 and the thickness direction of the main housing 10*a* as the short axis B2, so that the condensate in the smoke output tube 11*a* tends to aggregate at the end of the long axis B1 with a greater curvature. Furthermore, the end of the smoke output tube 11*a* is provided with a second notch 112*a* close to at least one side of the main housing 10*a* in the width direction. Through the second notch 112*a*, the end of the long shaft B1 with a large curvature is hollowed out, thereby eliminating the accumulation of condensate at the end and making more condensates accumulate to the position close to the first notch 111*a*, so as to make it convenient to guide the condensate to the vaporization chamber under the cooperation of the second convex edge 74*a*.

In a preferred embodiment shown in FIG. 14, a width of the first notch 111*a* is less than a width of the second notch 112*a*. In the embodiment, the width of the first notch 111*a* is about 2.4 mm, and the width of the second notch 112*a* is about 1 mm.

Figure 16:
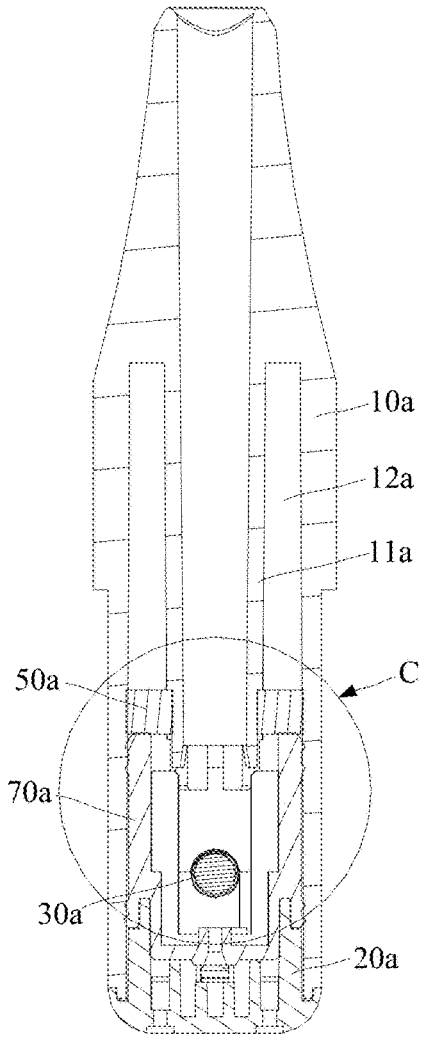
FIG. 16 is a schematic cross-sectional view of the vaporizer shown in FIG. 10 in a thickness direction.
Figure 17:
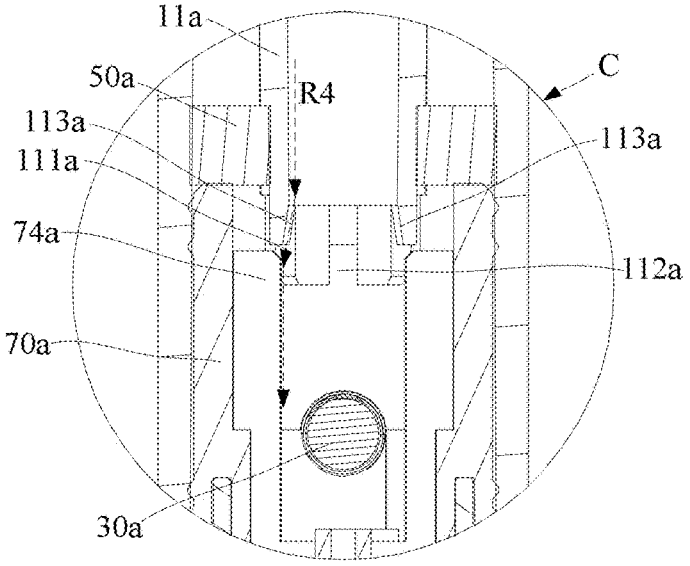
FIG. 17 is an enlarged diagram of portion C in FIG. 16.

In the embodiments shown in FIG. 16 and FIG. 17, the smoke output tube 11*a* has an inclined tube wall 113*a* close to the first notch 111*a*. During use, as indicated by arrow R4 in FIG. 17, the aerosol condensate on the inner wall of the smoke output tube 11*a* is drained from the inclined tube wall 113*a* to the first notch 111*a*, then sucked to the surface of the second convex edge 74*a* by a capillary channel formed by the second convex edge 74*a* and the first notch 111*a*, and then flows downward to the vaporization chamber in the outer support 70*a*. Moreover, as can be shown in FIG. 12 and FIG. 17, the second convex edge 74*a* is not in contact with the surface of the first notch 111*a*.

Figure 15:
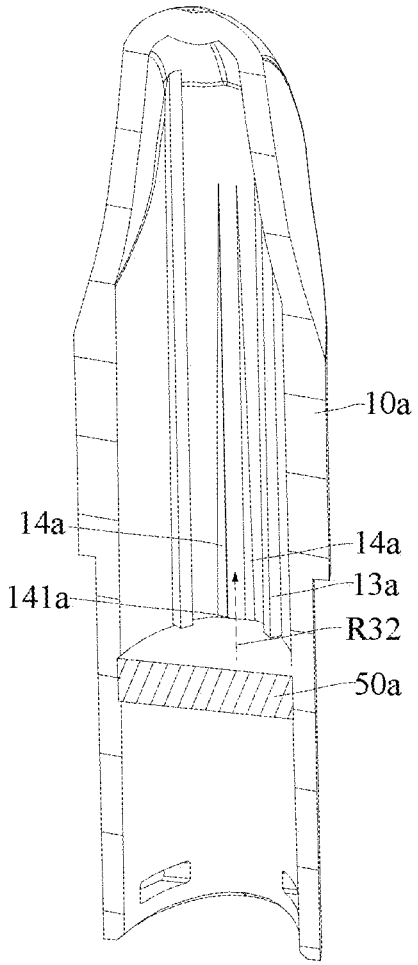
FIG. 15 is a schematic diagram of an air pressure balance channel formed between the second liquid guide element and the main housing in FIG. 10.

During use, with the consumption of the liquid substrate, the negative pressure in the liquid storage chamber 12*a* gradually increases, which affects the smooth transfer of the liquid substrate from the liquid storage chamber 12*a* to the second liquid guide element 30*a*. Furthermore, the vaporizer 100*a* is internally provided with an air pressure balance channel for replenishing air into the liquid storage chamber 12*a*, which alleviates the negative pressure in the liquid storage chamber 12*a* and ensures the smooth transfer of the liquid substrate. Referring to FIG. 13 to FIG. 15, the air pressure balance channel includes two channel portions communicated with each other in sequence, namely, the first channel portion indicated by arrow R31 in FIG. 13 and the second channel portion indicated by arrow R32 in FIG. 15. Specifically, at least one third convex edge 14*a* is arranged on the inner walls close to both sides of the main housing 10*a* in the width direction. Specifically, in FIG. 14, there are two third convex edges 14*a*, and a certain space 141*a* is retained between them. In conjunction with the space 141*a*, the peripheral side wall of the rigid first liquid guide element 50*a* in FIG. 11 has a straight portion 52*a* in structural arrangement. After assembly, the straight portion 52*a* abuts against the third convex edge 14*a*, thereby defining the space 141*a* and keeping the space from being filled or blocked.

Furthermore, an air groove 79*a* is provided on the surface of the outer support 70*a* close to the first liquid guide element 50*a*. In FIG. 13, an air groove 79*a* is located at both ends of the outer support 70*a* near the width direction. One side of the air groove 79*a* is communicated with the space inside the outer bracket 70*a*, namely, the vaporization chamber, and the other side is communicated with the above space 141*a*, so that the air in the vaporization chamber passes through the air groove 79*a* along the arrow R31 in FIG. 13, and then enters the liquid storage chamber 12*a* from the spacing 141*a* to the main housing 10*a* as indicated by the arrow R32 in FIG. 15, thereby alleviating or eliminating negative pressure in the liquid storage chamber 12*a*.

In the preferred embodiments shown in FIG. 14 and FIG. 15, the main housing 10*a* is also internally provided with a fourth convex edge 13*a* for abutting against and clamping the first liquid guide element 50*a* after assembly.

Figure 19:
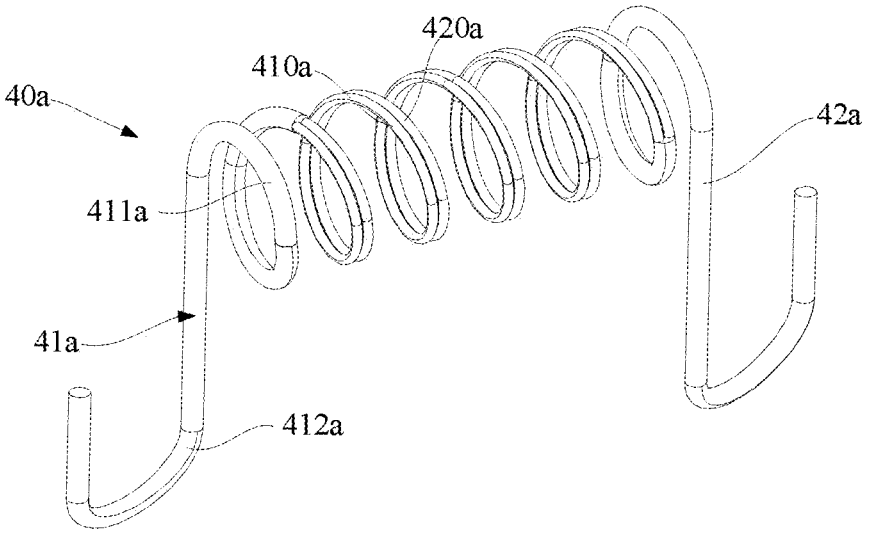
FIG. 19 is a schematic structural diagram of a heating element from still another perspective.

FIG. 19 shows a schematic diagram of a heating element 40*a* from still another perspective. The heating element includes a first electrical pin 41*a* and a second electrical pin 42*a* arranged opposite to each other in the length direction, and a first spiral coil 410*a* and a second spiral coil 420*a* extending between the first electrical pin 41*a* and the second electrical pin 42*a*. In this embodiment, the first spiral coil 410*a* and the second spiral coil 420*a* are connected in parallel after being powered by the first electrical pin 41*a* and the second electrical pin 42*a* at the same time. Structurally, the first spiral coil 410*a* and the second spiral coil 420*a* are closely connected in parallel. In an optional embodiment, the first spiral coil 410*a* and the second spiral coil 420*a* each have approximately 3-10 turns or windings, and an extension length of approximately 4-7 mm, and in FIG. 19, the first spiral coil and the second spiral coil each have 5 turns or windings, and a design length of 6.5 mm.

As shown in FIG. 19, the first spiral coil 410*a* and the second spiral coil 420*a* are parallel or staggered in the axial direction, rather than overlapped in the radial direction, and are at different positions with respect to the first portion 31*a* in the extension direction of the first portion 31*a* after assembly, so that the heating efficiency of the contact area with the first portion 31*a* is greater.

The wire material used in the first electrical pin 41*a* and the second electrical pin 42*a* has a diameter greater than that of the wire material used in the first spiral coil 410*a* and the second spiral coil 420*a*. That is, the first electrical pin 41*a* and the second electrical pin 42*a* are made from relatively thick wires, and the first spiral coil 410*a* and the second spiral coil 420*a* are made from relatively thin wires, so as to facilitate connection between the two ends of the first and second spiral coils and the first electrical pin 41*a* and the second electrical pin 42*a*. In a specific embodiment, the first electrical pin 41*a* and the second electrical pin 42*a* are made from wires with a diameter of about 1.5 mm, and the first spiral coil 410*a* and the second spiral coil 420*a* are made from wires of 0.4 mm.

In an optional embodiment, the first spiral coil 410*a* and the second spiral coil 420*a* are made from suitable resistive metals or alloys, such as Fe—Cr—Al, Ni—Cr alloy, etc., which have a relatively large temperature coefficient of resistance. The first electrical pin 41*a* and the second electrical pin 42*a* provide the function of electrical pins and are made from metals or alloys with high electrical conductivity and low resistivity, such as gold, silver, copper, etc., or the electrical pin may be a slender pin prepared by forming the above-mentioned metal coating on the outer surface of the filamentous substrate.

Further referring to FIG. 19, the first electrical pin 41*a* includes an annular supporting portion 411*a* and an electric connection portion 412*a*, where the annular supporting portion 411*a* is connected to the first spiral coil 410*a* and the second spiral coil 420*a*, and their spiral dimensions, such as outer or inner diameters, are substantially the same; and furthermore, during assembly, the annular supporting portion 411*a* can also surround the first portion 31*a* of the second liquid guide element 30*a*, so that after assembly, the first portion 31*a* of the second liquid guide element 30*a* is supported by the annular supporting portion 411*a* of the first electrical pin 41*a*. The electric connection portion 412*a* runs through the outer bracket 70*a*, so as to be abutted against or welded to the second electrical contact 21*a*.

Further referring to FIG. 18, after assembly, the first spiral coil 410*a* and the second spiral coil 420*a* of the heating element 40, instead of being in contact with the inner wall of the outer support 70*a* and/or the wall of a first retaining cavity 71*a*, are retained on the inner wall of the outer support 70*a* and/or the wall of the first retaining cavity 71*a* through the annular supporting portion 411*a* of the first electrical pin 41*a*, thereby supporting the heating element 40*a*. In operation, the first electrical pin 41*a* and the second electrical pin 42*a* have a lower temperature than the first spiral coil 410*a* and the second spiral coil 420*a*, so as to avoid thermal damage to the outer support 70*a*.

Further referring to FIG. 10, FIG. 18 and FIG. 19, the electric connection portion 412*a* of the first electrical pin 41*a* is in a bent hook shape; and in an assembled structure, the outer support 70*a* has a lead hole 781*a* that runs through the inner wall to the surface facing the end cap 20*a*, and a contact hole 782*a* arranged toward the end cap 20*a* and configured to at least partially accommodate the second electrical contact 21*a*. After assembly, the electric connection portion 412*a* runs through the lead hole 781*a* and then extends or bends into the contact hole 782*a* to achieve electric conduction with the second electrical contact 21*a*.

Certainly, the second electrical pin 42*a* has a structure, connection and assembly the same as the first electrical pin 41*a*.

In an optional embodiment, the above heating element 40*a* has an inner diameter of about 2-4 mm, preferably 2.3 mm-2.6 mm; and the heating element 40*a* has a resistance of about 0.5-2 Ohm.

Figure 20:
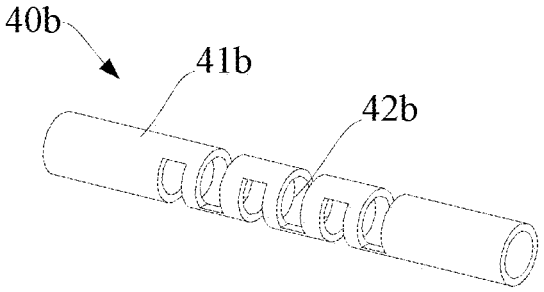
FIG. 20 is a schematic structural diagram of a heating element according to still another embodiment.

In other alternate embodiments, the heating element 40*a* may alternatively be formed by a mesh substrate wound around the first portion 31*a*. Alternatively, furthermore, FIG. 20 shows a schematic diagram of a heating element 40*b* according to an embodiment, the heating element being formed by means such as cutting a tubular substrate 41*b* to form square notches or hollow holes 42*b*; and during use, heating is performed around the first portion 31*a* to generate an aerosol for inhalation.

It is to be understood that, the specification and the accompanying drawings of this application provide preferred embodiments of this application, but it is not limited to the embodiments described in this specification. Further, a person of ordinary skill in the art may make improvements or modifications according to the foregoing descriptions, and all the improvements and modifications shall fall within the protection scope of the appended claims of this application.

What is claimed is:

1. A vaporizer, configured to vaporize a liquid substrate to generate an aerosol, comprising an outer housing, wherein the outer housing is internally provided with:

a liquid storage chamber, configured to store a liquid substrate; the liquid storage chamber having an opening;

a first liquid guide element having a first surface close to the liquid storage chamber in a longitudinal direction of the outer housing, and a second surface away from the first surface, wherein the first surface is configured to be in fluid communication with the liquid storage chamber to suck and buffer the liquid substrate in the liquid storage chamber; and the first liquid guide element is made from an organic porous material and is configured to cover the opening to seal the liquid storage chamber, such that the liquid substrate in the liquid storage chamber is substantially removed through the first liquid guide element;

a second liquid guide element, configured to at least partially contact with the second surface to suck the liquid substrate; and a heating element, configured to heat at least part of the liquid substrate in the second liquid guide element to generate an aerosol;

wherein the first liquid guide element has an elastic modulus or a stiffness smaller than an elastic modulus or a stiffness of the material of the liquid storage chamber and larger than an elastic modulus or a stiffness of the material of the second liquid guide element.

2. The vaporizer according to claim 1, wherein the first liquid guide element is made from an organic porous material with elasticity.

3. The vaporizer according to claim 1, wherein the first liquid guide element directly contacts with and covers the opening of the liquid storage chamber.

4. The vaporizer according to claim 1, wherein the first liquid guide element is configured as a sheet or block perpendicular to the longitudinal direction of the outer housing.

5. The vaporizer according to claim 4, wherein the first liquid guide element has a length direction perpendicular to the longitudinal direction of the outer housing and a width direction perpendicular to the longitudinal direction and the length direction of the outer housing; and a length dimension of the first liquid guide element is greater than a width dimension of the same.

6. The vaporizer according to claim 4, wherein the first liquid guide element has a length direction perpendicular to the longitudinal direction of the outer housing and a width direction perpendicular to the longitudinal direction and the length direction of the outer housing; wherein the first liquid guide element is anisotropic; a flexural strength in the length direction is greater than a flexural strength in the width direction; a liquid guide rate in the length direction is greater than a liquid guide rate in the width direction; and the first liquid guide element comprises fibers arranged and oriented substantially in the length direction.

7. The vaporizer according to claim 6, wherein the first surface and/or the second surface of the first liquid guide element has a line extending substantially in the length direction.

8. The vaporizer according to claim 1, further comprising:

a first support arranged adjacent to the second surface of the first liquid guide element in the longitudinal direction of the outer housing, and configured to at least partially accommodate and retain the second liquid guide element.

9. The vaporizer according to claim 1, wherein the second liquid guide element comprises a first portion extending in a direction perpendicular to the longitudinal direction of the outer housing, and a second portion extending from the first portion to the first liquid guide element, wherein the second portion is configured to contact with the second surface to suck the liquid substrate; and the heating element at least partially surrounds the first portion.

10. The vaporizer according to claim 1, wherein the outer housing has an inner wall at least partially defining the liquid storage chamber;

the inner wall is provided with a first convex edge extending in the longitudinal direction of the outer housing; and the first convex edge is configured to at least partially retain the first liquid guide element by abutting against the first surface.

11. The vaporizer according to claim 1, further comprising:

an air channel providing a flowing path for air to enter the liquid storage chamber.

12. The vaporizer according to claim 11, wherein the outer housing is internally provided with: an inner wall defining the liquid storage chamber configured to store a liquid substrate; and the air channel comprises a first channel portion formed between the first liquid guide element and the inner wall.

13. The vaporizer according to claim 12, further comprising:

a first support arranged close to the second surface of the first liquid guide element in the longitudinal direction of the outer housing, and configured to at least partially define a vaporization chamber surrounding the second liquid guide element and/or the heating element; and the air channel further comprises a second channel portion allowing air in the vaporization chamber to enter the first channel portion, the second channel portion being at least partially formed between the first support and the first liquid guide element.

14. The vaporizer according to claim 9, further comprising:

a liquid buffer space configured to buffer the liquid substrate to adjust the efficiency of transferring the liquid substrate to the heating element.

15. The vaporizer according to claim 14, wherein the liquid buffer space comprises at least one first capillary groove; and the first capillary groove is arranged to at least partially contact with the first portion, and is positioned on at least one side of the heating element in an extension direction of the first portion.

16. The vaporizer according to claim 15, wherein the liquid buffer space further comprises a second capillary groove arranged surrounding the second portion.

17. The vaporizer according to claim 16, further comprising:

a second support, accommodated in the first support, and at least partially accommodating and retaining the second portion; and the liquid buffer space further comprises a third capillary groove arranged on a surface of the second support adjacent to the second portion.

18. An electronic vaporization device, comprising a vaporizer configured to vaporize a liquid substrate to generate an aerosol, and a power supply assembly supplying power to the vaporizer, wherein the vaporizer comprises the vaporizer according to claim 1.

19. A vaporizer, configured to vaporize a liquid substrate to generate an aerosol, comprising an outer housing, wherein the outer housing is internally provided with:

a liquid storage chamber, configured to store a liquid substrate;

a liquid guide element, comprising a first portion extending in a direction perpendicular to a longitudinal direction of the outer housing, and a second portion extending from the first portion to the liquid storage chamber in the longitudinal direction of the outer housing, wherein the second portion is configured to be in fluid communication with the liquid storage chamber to suck the liquid substrate; and a heating element at least partially surrounding the first portion, and being configured to heat at least part of the liquid substrate in the liquid guide element to generate an aerosol, wherein the heating element comprises a heating portion and an electrical pin for supplying power to the heating portion; the electrical pin comprises an annular supporting portion having at least one turn, the annular supporting portion being configured to at least partially support the liquid guide element by surrounding the first portion.

* * * * *